US006771011B2

(12) United States Patent
Maxim et al.

(10) Patent No.: US 6,771,011 B2
(45) Date of Patent: Aug. 3, 2004

(54) DESIGN STRUCTURES OF AND SIMPLIFIED METHODS FOR FORMING FIELD EMISSION MICROTIP ELECTRON EMITTERS

(75) Inventors: Michael A. Maxim, San Jose, CA (US); Oleh Karpenko, San Jose, CA (US); Farshid Adibi-rizi, San Jose, CA (US); Brett E. Huff, Fremont, CA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 10/383,966

(22) Filed: Mar. 7, 2003

(65) Prior Publication Data

US 2003/0146682 A1 Aug. 7, 2003

Related U.S. Application Data

(62) Division of application No. 09/820,338, filed on Mar. 28, 2001, now Pat. No. 6,572,425.

(51) Int. Cl.[7] ..... H01J 1/304

(52) U.S. Cl. ..... 313/309; 313/310; 445/50

(58) Field of Search ..... 313/309, 310, 313/311, 351, 336, 422, 495, 496, 497; 315/169.3; 445/24, 50

(56) References Cited

U.S. PATENT DOCUMENTS 5,210,472 A * 5/1993 Casper et al. ..... 315/349
5,228,877 A 7/1993 Allaway et al.
5,494,179 A 2/1996 Hori et al.
5,587,623 A * 12/1996 Jones ..... 313/497
6,064,145 A * 5/2000 Lee ..... 313/309
6,091,190 A * 7/2000 Chalamala et al. ..... 313/346 R
6,133,151 A 10/2000 Lin
6,204,608 B1 * 3/2001 Song et al. ..... 315/169.3
6,312,966 B1 * 11/2001 Tseng ..... 438/20
6,566,804 B1 * 5/2003 Trujillo et al. ..... 313/495

FOREIGN PATENT DOCUMENTS

FR 2 709 206 A1 6/1994

OTHER PUBLICATIONS

PCT US02/07176, International Search Report, Apr. 11, 2003.

* cited by examiner

*Primary Examiner*—Nimeshkumar D. Patel
*Assistant Examiner*—Karabi Guharay
(74) *Attorney, Agent, or Firm*—Blakely, Sokoloff, Taylor & Zafman LLP

(57) ABSTRACT

Electron emission structures formed using standard semiconductor processes on a substrate first prepared with a topographical feature are disclosed. At least one layer of a first material is concurrently deposited on the substrate and etched from the substrate to form an atomically sharp feature. An at least one layer of a second material is deposited over the atomically sharp feature. A conductive layer is deposited over the at least one layer of the second material. A selected area of material is removed from the conductive layer and the at least one layer of second material to expose the atomically sharp feature. Finally, electrical connectivity is provided to elements of the electron emission structure.

16 Claims, 13 Drawing Sheets

PIXEL/LETI CATHODE PROCESS USING
SPINDT MO MICROTIPS

METAL MICROTIPS MADE WITH ANISTROPIC SI ETCH AND MOLD LIFTOFF - HENRY GRAY (1981)

SI MICROTIPS MADE IN A GRIDDED STRUCTURE
HENRY GRAY (1990)

SILICON MICROTIPS MADE WITH
TETRODE STRUCTURE
J. ITOH ET AL ELECTROTECHNIAL LAB IBARAKE, JAPAN (MITSUBISHI)

KANAMARU ET AL ELECTRO TECHNICAL LAB
IBARAKI, JAPAN NMC '94 (FUTATA)

(1) FIRST PHOTOLITHOGRAPHY & RIE & THERMAL OXIDATION (4) SECOND PHOTOLITHOGRAPHY (2) GATE ELECTRODE FORMATION (4) RIE

- WEDGE LENGTH IS 2μM
- WEDGE PITCH IS 4μM
- $V_G$ = 140V (3) LIFT OFF PROCESS

SI VERTICAL WEDGE
J.G. FLEMING ET AL, SANDIA, IVMC 1994

(1) DEPOSIT AND PATTERN OXIDE (2) DEPOSIT AND PATTERN GRID (3) DEPOSIT SPACER OXIDE (4) DEPOSIT CONDUCTING EMITTER OXIDE (5) FORM EMITTER WEDGE BY RIE (6) PARTIALLY REMOVE OXIDE SEPARATOR

SILICON EMITTER WITH VOLCANO GATE
SHANGHAI, IVMC '93 LI ET AL EAST CHINA NORMAL UNIVERSITY

- POTENTIAL PROBLEMS
- SMALL SPACING ENCOURAGES LEAKAGE FROM CATHODE TO GRID
- SHARP GRID EDGES ENCOURAGES SPURIOUS EMISSION GRID TO ANODE

PRIOR ART APPLICATIONS:

PRIOR ART APPLICATION OF FIELD EFFECT EMITTERS FOR FE FLAT PANEL DISPLAY; FORMATION OF THE TIPS WAS SEPERATE AND PROBLEMATIC.

ANODE (ROW): METALLIZED PHOSPHOR STRIPES

ANOTHER FLAT PANEL DISPLAY EXAMPLE.

DESIGN STRUCTURES OF AND SIMPLIFIED METHODS FOR FORMING FIELD EMISSION MICROTIP ELECTRON EMITTERS

CROSS-REFERENCE TO RELATED APPLICATIONS

This application is a divisional of, and claims priority under 35 U.S.C. § 120 from U.S. patent application Ser. No. 09/820,338, filed Mar. 28, 2001, and now U.S. Pat. No. 6,572,425.

BACKGROUND OF THE INVENTION

1. Field of the Invention

The present invention relates generally to semiconductor devices, and in particular, relates to topographic features of semiconductor devices.

2. Background Information

Semiconductor fabrication techniques usually involve multi-step processes. Some multi-step processes are very expensive because different fabrication techniques or materials are required for each process step. Additionally, the fabrication process for one material might be incompatible with another process due to cross-contamination by dopants or etching materials. Devices created with single-crystal silicon, for example have a much lower yield and a higher failure rate than anisotropic silicon devices. The high heat required for some single-crystal fabrication excludes processing at the end of a manufacturing cycle. Therefore, it is difficult to form devices of high quality and uniformity using single-crystal materials or to combine production of such devices with other semiconductor fabrication processes.

One use of single-crystal semiconductor fabrication is the formation of atomically sharp topographies. Atomically sharp topographies are generally formed using crystallographic etched monolithic films of tungsten, silicon, or diamond-like films. The processes used to create atomically sharp topographies using single-crystal fabrication cannot easily be combined with other semiconductor processes due to high temperatures and other constraints. Atomically sharp topographies are very desirable for several applications.

One use for an atomically sharp object is a field emission structure. Field emission structures are well known in the art and include devices such as field emission microtip electron emitters, area emitters, and Field Effect Transistors (FETs). The term "field emission microtip electron emitter" is interchangeable with Field Emission (FE) electron emitter, microtip emitter, cold-cathode tip emitter, Spindt tip emitter, field tip emitter and tip emitter. The field emission electron emitter is a field effect device that emits charged particles when a voltage potential is applied in a particular manner. The charged particle emissions may be controlled by changing the potential voltage with respect to regions of the device. In general, a microtip field emitter has several components including a substrate or base, an atomically sharp feature known as a tip, emitter tip or microtip, and a bias plane. Fabrication of the atomically sharp emitter microtip has generally required the use of single-crystal materials. There are a number of techniques for creating atomically sharp topographies on a substrate for use in a field emission structure.

Field emission electron emitters are usually formed using photolithographic and lift-off techniques to form atomically sharp topographic features on a monolithic film. The methods used to form emitter microtips include molding, electro-etching and thermal oxidation. An example of several methods for creating field emission emitters.

FIG. 1 is an illustration of a technique for creating microtip emitters. The technique is attributed to the French national laboratory, Laboratoire d'Electronique de Technologie et d'Instrumentation (LETI), and illustrates a method of forming what are generally known as Spindt emitters after Dr. Capp Spindt of the Stanford Research Institute.

FIG. 2 is an illustration of a technique for creating a microtip. The technique of Henry Gray relies on an etched silicon mold that is subsequently used, as a mold for a metal microtip. A substrate of silicon crystal is etched using an anisotropic etching process to form a pyramidal pit to be used as a mold. The silicon mold is deposited with a metal layer then silicon mold is etched away leaving the metal layer with an atomically sharp microtip.

FIG. 3 is an illustration of a technique for creating microtip emitters. The technique of Henry Gray applies the microtip of FIG. 2A to form microtip emitters. FIG. 4 is an illustration of a technique for creating microtip emitters. The technique of J. Itoh et al, of Electrotechnical lab Ibarake, Japan, utilizes a tetrode structure to form microtip emitters.

FIG. 5 is an illustration of a technique for creating microtip emitters. The technique of Kanamaru et al of Electrotechnical lab Ibarake, Japan, utilizes a two-stage photolithography and lift-off process with Reactive Ion Etching (RIE). The resulting wedges may be used as field tip emitters.

FIG. 6 is an illustration of a technique for creating a wedge emitter. The technique of J. G Flemming et al forms wedge shaped emitters.

FIG. 7 is an illustration of a prior art technique for creating microtip emitters. The technique of Li et al East China Normal University utilizes an oxidation and pattern-transfer process to form microtips.

FIG. 8 is an illustration of an application for microtip emitters. Field Emission (FE) flat panel displays have been created using microtip emitters. FE flat panel displays incorporating prior art microtip emitters generally require separate formation processes for the emitter tip and the emitter device.

Each of the above methods involves a multi-step process that requires special process conditions and is expensive. Additionally, the above methods do not easily allow multiple emission structures to be aligned in arrays with reliable uniformity, or the formation of different emitter geometries using one process. Finally, the above designs for field emission electron emitters are complex physical implementations with multiple components, again leading to high manufacturing costs and unreliable performance. Field emission electron emitters have a number of potential uses that are rendered impractical by the high cost, inherently low yield and difficulty of single-crystal design and fabrication.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DETAILED DESCRIPTION OF THE ILLUSTRATED EMBODIMENTS

Figure 1:
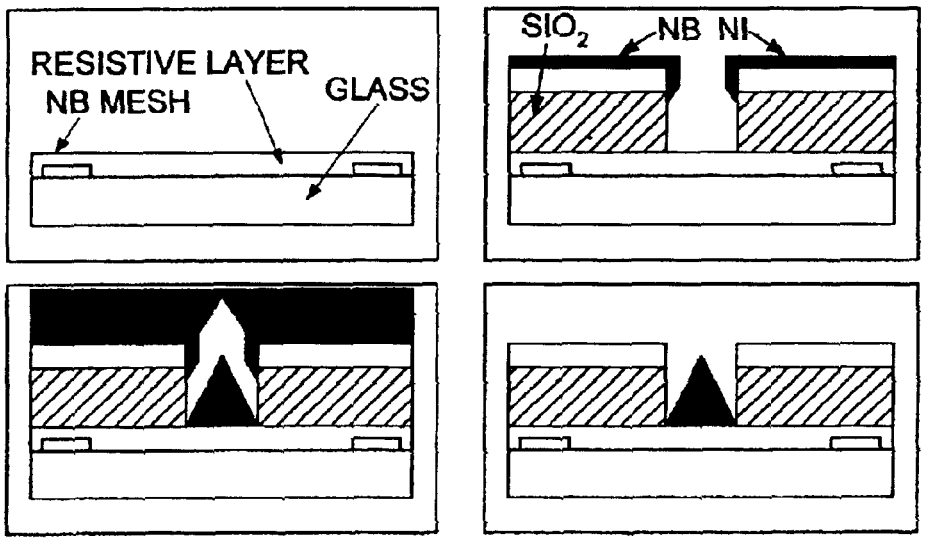
FIG. 1 is an illustration of a technique for creating microtip emitters.

Embodiments of a design for new design structures and simplified methods for forming field emission structures are described herein. In the following description, numerous specific details are provided. However, one skilled in the relevant art will recognize that the invention can be practiced without one or more of the specific details, or with other methods, components, materials, etc. In other instances, well-known structures, materials, or operations are not shown or described in detail to avoid obscuring aspects of the invention.

Reference throughout this specification to "one embodiment" or "an embodiment" means that a particular feature, structure, or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

Various operations will be described as multiple discrete steps performed in a manner that is most helpful in understanding the invention. However, the order in which the steps are described does not imply that the operations are order-dependent or that the order that steps are performed must be the order in which the steps are presented.

The above problems are solved by a simplified electron emission structure formed using standard semiconductor processes wherein a substrate is first prepared with a patterned topographical feature. At least one layer of a first material; is then concurrently deposited on the substrate and etched to form an atomically sharp feature. At least one layer of a conductive emission material is then deposited over the atomically sharp feature. At least one layer of an insulating material is then deposited over the conductive emission material. A conductive bias layer is then deposited over the at least one layer of insulating material. A region of deposited layers is then removed to expose the atomically sharp feature. Finally, electrical connectivity is provided to elements of the electron emission structure.

In an embodiment of the invention, a field emission structure is formed on a substrate. In another embodiment of the invention, highly uniform atomically sharp emitter microtips are self-formed and self-aligned using a continuous deposition and etch process such as a High Density Plasma (HDP) process. In an embodiment of the invention, the field emission structure may be formed concurrently with other components using standard semiconductor fabrication techniques. In an embodiment of the invention, an emission enhancing material is incorporated in field emission electron emitter fabrication for enhanced performance. In yet another embodiment of the invention, field emission emitter fabrication is secondary to a primary fabrication process. In yet another embodiment of the invention, field emission emitter microtips are further conditioned after fabrication by processes such as, but not limited to, electropolishing.

In one embodiment of the invention, each of a plurality of field emitters is individually addressed with an electrical connection. In another embodiment of the invention, an array of field emitters is electrically connected. In yet another embodiment of the invention, a plurality of field emitters is electrically connected to provide electrostatic charge dissipation. In yet another embodiment of the invention, a device incorporating field emitters is fabricated according to the field emitter fabrication techniques of the invention.

In an embodiment of the invention, a Field Emission Display (FED) is fabricated using the field emitters of the invention. In yet another embodiment of the invention, a current source is formed using the field emitters of the invention. In another embodiment of the invention, a voltage source is formed using the field emitters of the invention. In yet another embodiment of the invention, an ion pump is formed using the field emitters of the invention. In yet another embodiment of the invention, a package-level interconnect device is formed using the field emitters of the invention. In still another embodiment of the invention, a silicon vacuum tube is formed using the field emitters of the invention. In another embodiment of the invention, a switch is formed using the field emitters of the invention.

Figure 9:
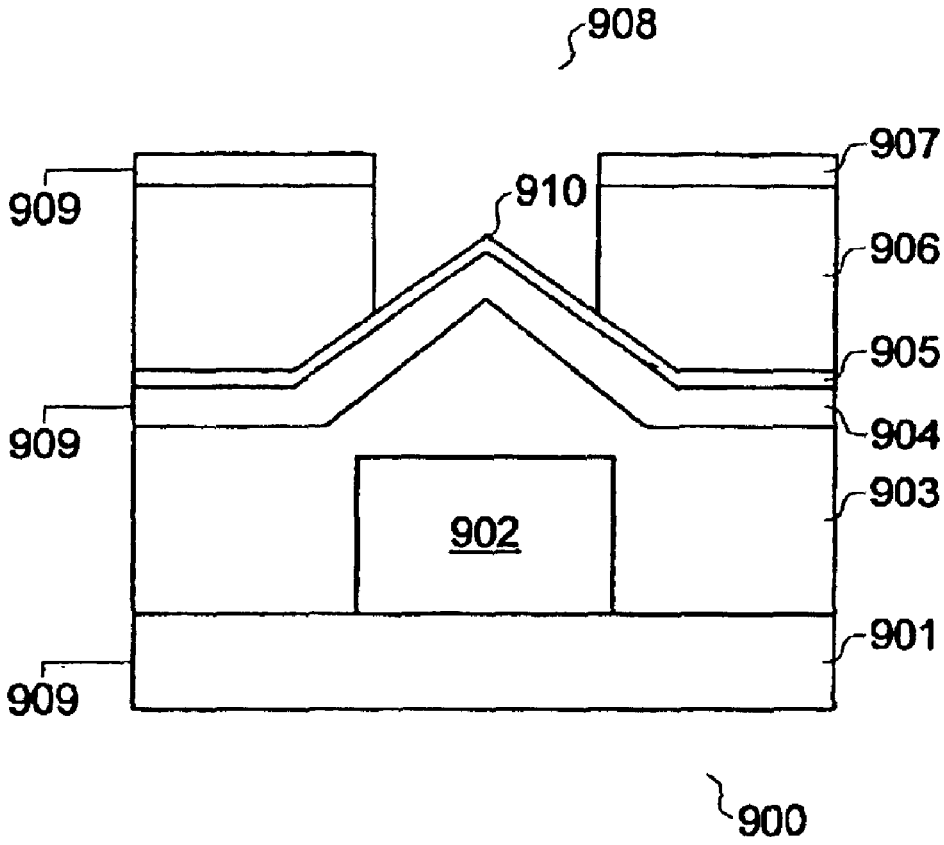
FIG. 9 is an illustration a field emission structure in an example of the invention.
Figures 10, 11:
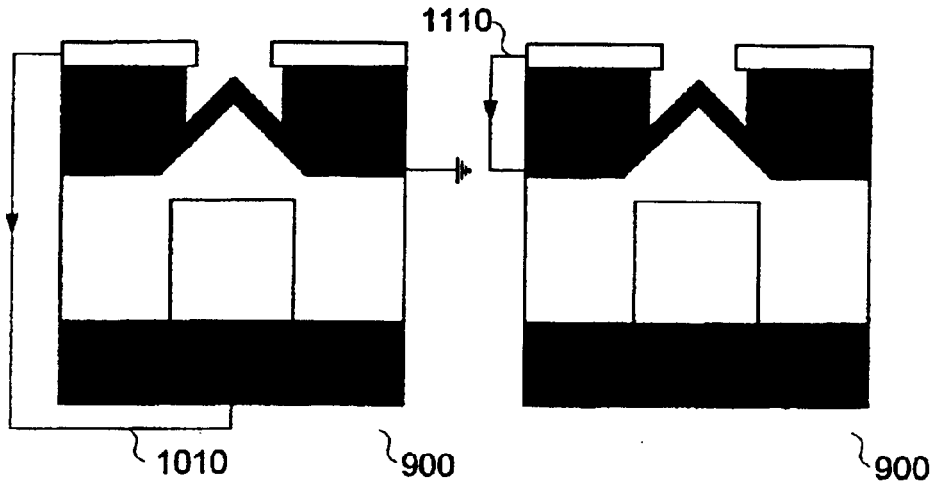
FIG. 10 illustrates an electrical configuration for a field emission microtip emitter in an example of the invention.
FIG. 11 illustrates an electrical configuration for a field emission microtip emitter in an example of the invention.

Simplified Field Emission Structures FIGS. 9–11

FIG. 9 is an illustration a field emission structure in an example of the invention. In one embodiment of the invention, a field emission electron emitter 900 is formed on a substrate 901. Substrate 901 is prepared with a patterned topographical feature 902. The substrate is generally anisotropic silicon but may be any suitable material. A significant feature of the present invention is that single-crystal material is not required as a component. The topographical feature 902 may be any geometric design having width, length and height chosen for the specified application. One inherent advantage of the present invention is the ability to combine different topographic features on the same substrate using conventional patterning techniques. The patterning technique may be any method whereby a topographic feature is produced on a substrate, but is generally a deposition process.

At least one layer of a first material 903 is deposited over the substrate 901 containing the topographic feature 902 using a concurrent etch and deposit process, such as High Density Plasma Chemical Vapor Deposition (HDP-CVD) for example, to form an atomically sharp feature over the topographical feature 902. The first material 903 may be a conductor, semiconductor or insulator depending on the application, but is generally an insulator, such as an oxide. The atomically sharp feature is a field emission tip or microtip of appropriate geometry for field emission.

Optionally, a layer of conductive emission material 904 may be-deposited over the first material 903, if for example the first material is an insulator. The conductive emission material is any conductor with a low work function and high emissivity such as tungsten, molybdenum, or a diamond-like graphite film for example. In an embodiment of the invention, a layer of emission enhancing material 905, such as thoriated tungsten for example, is additionally deposited on the conductive layer 904.

At least one layer of insulating material 906 is deposited over the at least one layer of conductive material 904 and any additional layers such as 905 for example. The insulating layer 906 may be any insulating material suitable for the application, but is generally an oxide of silicon.

A layer of conductive bias material 907 is deposited over the at least one layer of insulating material 905. The conductive bias layer may be any conductive material suitable for the application, but is generally aluminum or another common semiconductor connecting material. The conductive bias material 907 provides an electrical bias plane to the microtip emitter 900.

Deposited layers of material such as conductive bias material 907 and insulating material 906 are removed in a region 908 to expose the conductive material 904. The material removal process may be any method compatible with semiconductor fabrication, but is generally a mask and etch process.

An electrical connection 909 is provided to elements of the emission structure. As depicted in FIG. 9, electrical connection 909 may be to conductive bias material 907, to conductive material 904 or to substrate 901.

FIG. 10 illustrates an electrical configuration for a field emission microtip emitter in an example of the invention. A field emission electron emitter, such as 900 of FIG. 9, is depicted with a potential voltage 1010 across the conductive bias material 907 and the substrate 901.

FIG. 11 illustrates an electrical configuration for a field emission microtip emitter in an example of the invention. A field emission electron emitter 900 is depicted with a potential voltage 1110 across the conductive bias material 907 and the conductive material 904.

Simplified Method for Forming Field Emission Structures FIGS. 12–23

Figure 23:
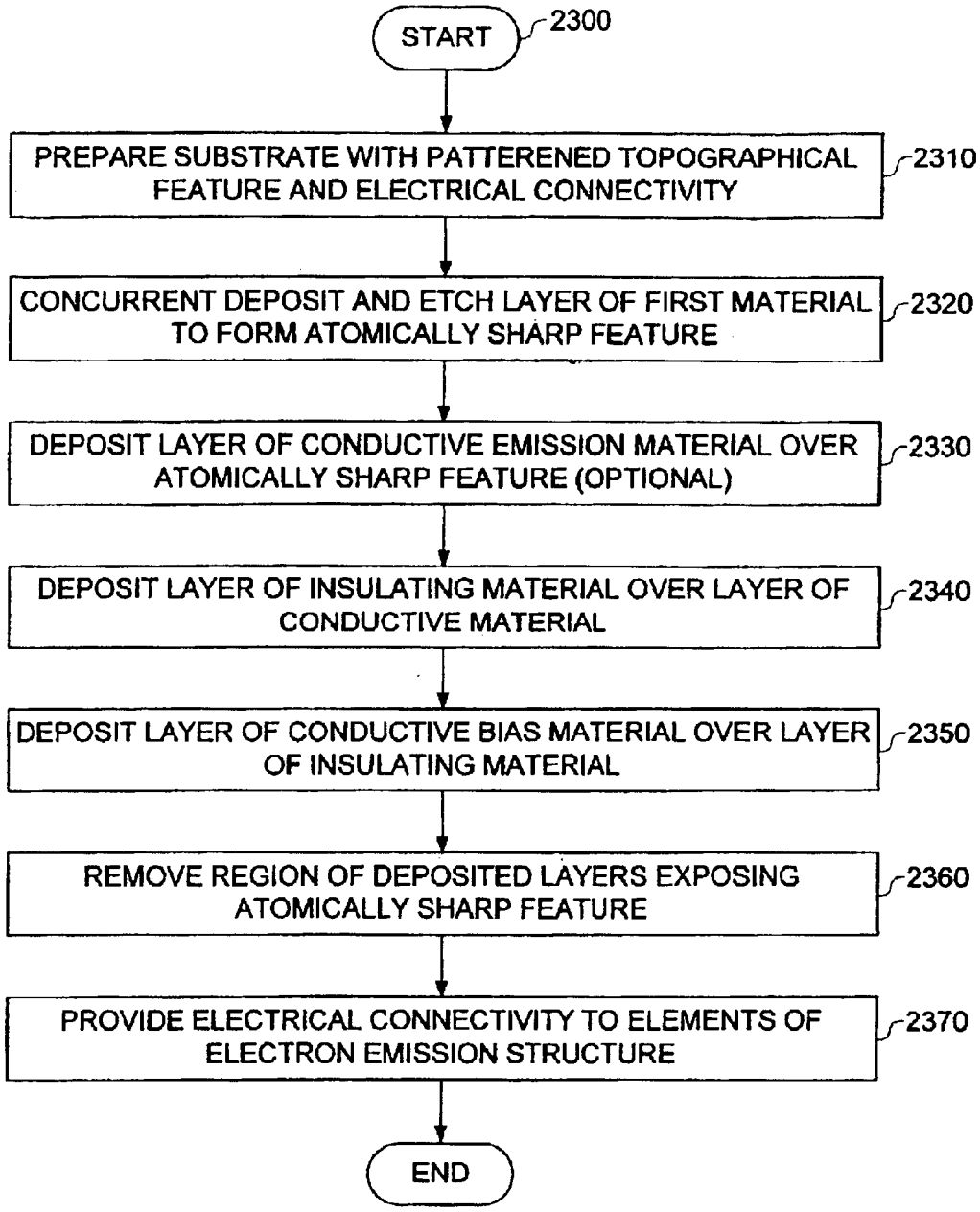
FIG. 23 is a flowchart of a process for creating field emission structures in an example of the invention.

FIG. 23 is a flowchart of a process for creating field emission structures in an example of the invention. Process 2300 of FIG. 23 begins in step 2310. FIGS. 12–19 illustrate combined steps of a simplified process flow for forming an array of field emission microtip emitters consistent with process 2300 of FIG. 23. Numbered elements of FIGS. 12–19 are carried though since the diagrams represent a process flow operating on the same elements. FIGS. 12–19 do not describe all possible process steps for creating field emission electron emitters as contemplated by the present invention and are not exclusive of additional or optional steps.

Figure 12:
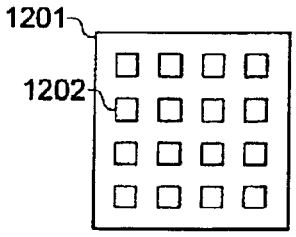
FIGS. 12–19 illustrate combined steps of a simplified process flow for forming an array of microtip emitters consistent with process 2300 of FIG. 23.
Figure 13:
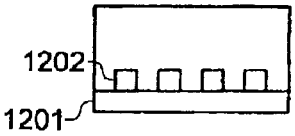

FIG. 12 is a top view of a patterned topographical feature. FIG. 12 contains a substrate 1201 and a patterned topographical feature 1202. FIG. 13 is a side view of a patterned topographic feature corresponding to FIG. 12. FIG. 13 contains a substrate 1201 and patterned topographical feature 1202.

Substrate 1201 is prepared with a patterned topographical feature 1202 in step 2310. In an alternative embodiment of the invention, step 2310 includes providing electrical connections on the substrate.

Figure 14:
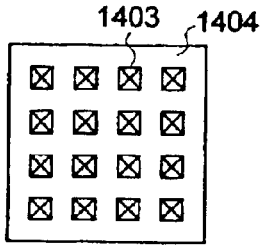
Figure 15:
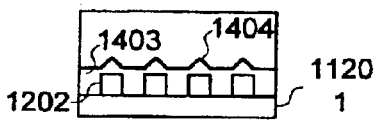

FIG. 14 is a top view of an atomically sharp feature deposited with a conductive layer. FIG. 14 contains an atomically sharp feature 1403 and a conductive layer 1404. FIG. 15 is a side view of an atomically sharp feature deposited with a conductive layer corresponding to FIG. 14. FIG. 15 contains a substrate 1201, a patterned topographical feature 1202, an atomically sharp feature 1403, and a conductive layer 1404. A layer of a first material is concurrently deposited and etched to form an atomically sharp feature 1403 in step 2320. The first material may be a conductor, insulator or semiconductor material. The size, spacing and minimum height of the atomically sharp feature 1403 is determined by the shape of the patterned topographical feature 1202. A conductive material 1404 may optionally be deposited over the atomically sharp feature 1403 in step 2330.

Figure 16:
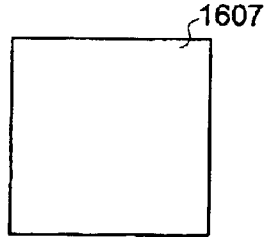
Figure 17:
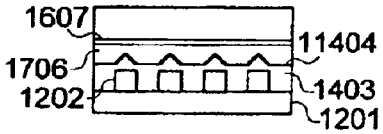

FIG. 16 is a top view of a conductive bias layer. FIG. 16 contains a conductive bias layer 1607. FIG. 17 is a side view of a conductive bias layer corresponding to FIG. 16. FIG. 17 contains a substrate 1201, a patterned topographical feature 1202, an atomically sharp feature 1403, a conductive layer 1404, an insulating layer 1706 and a conductive bias layer 1607. Insulating layer 1706 is deposited over the conductive layer 1404 in step 2340. Conductive bias layer 1607 is deposited over insulating layer 1706 in step 2350.

Figure 18:
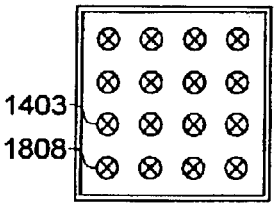
Figure 19:
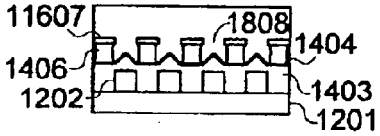

FIG. 18 is a top view of an array of field emission microtip emitters. FIG. 18 contains a pattern of removed material 1808 exposing atomically sharp features 1403. FIG. 19 is a side view of an array of field emission microtip emitters corresponding to FIG. 18. FIG. 19 contains a substrate 1201, a patterned topographical feature 1202, an atomically sharp feature 1403, a conductive layer 1404, an insulating layer 1706, a conductive bias layer 1607 and a pattern of removed material 1808 exposing the atomically sharp feature 1403. Material is removed from regions 1808 to expose atomically sharp features in step 2360.

Finally, electrical connectivity is provided to elements of the electron emission structure in step 2370. In an embodiment of the invention, a simultaneous fabrication process forms electrically functional devices on the substrate 1201. An electrically functional device is a passive or active device such as a resistor, capacitor, inductor, diode, wire trace, transistor, Light Emitting Diode (LED), photoresistor, or any combination of such devices that may function as elements of an electrical circuit.

An advantage of the present invention is the trivial formation of atomically sharp objects of varying size and shape using inexpensive materials and standard semiconductor fabrication techniques. An atomically sharp object used as an emitter microtip has a sharp geometry that promotes the emission of particles. The invention allows a unique particle emission characteristic for each emitter application since the topography of the emitter microtip can be tailored by the underlying geometry of the topographic feature on the substrate. An HDP-CVD process creates predictable microtip geometry depending on the size, spacing and minimum height of the underlying topographic feature.

Figure 20:
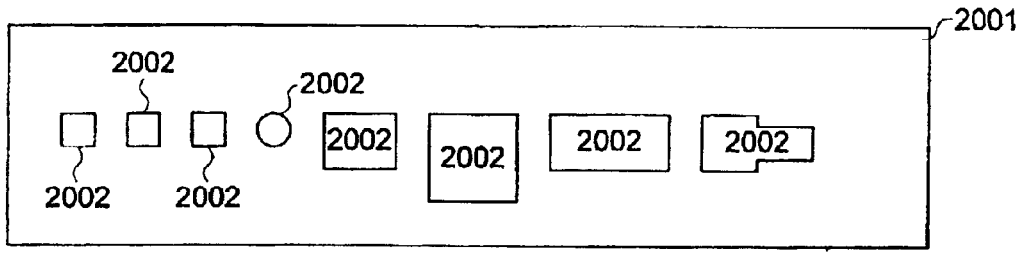
FIG. 20 illustrates patterned topographies on a substrate.

FIG. 20 illustrates patterned topographies on a substrate. A substrate 2001 contains several patterned topographical features 2002. The topographical features 2002 illustrated in FIG. 20 have varying sizes, shapes and heights.

Figure 21:
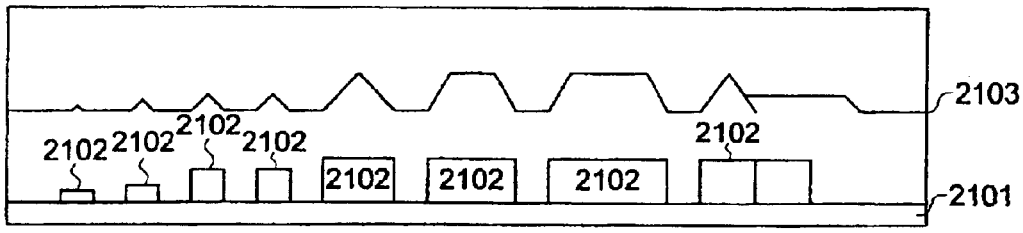
FIG. 21 illustrates atomically sharp objects corresponding to the patterned topographies of FIG. 20.

FIG. 21 illustrates atomically sharp objects corresponding to the patterned topographies of FIG. 20. Deposition of material 2103 using an HDP-CVD process over the topographic features 2002 as in step 2320 of process 2300 produces atomically sharp objects of varying geometries.

Figure 22:
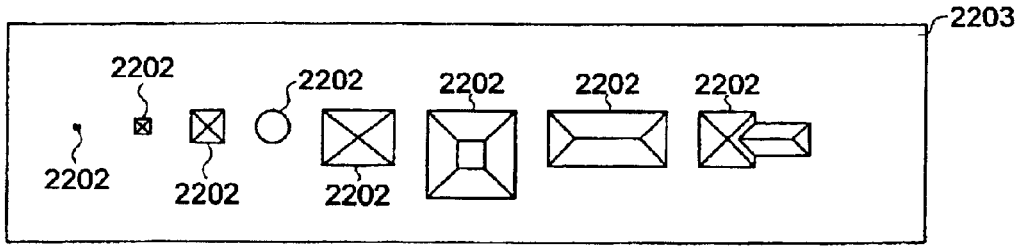
FIG. 22 is a top view of atomically sharp objects corresponding to the patterned topographies of FIG. 21.

FIG. 22 is a top view of atomically sharp objects corresponding to the patterned topographies of FIG. 21. Microtips 2202 are formed using HDP-CVD deposited material 2203. Each of the topographic features depicted in FIGS. 21–22 may be combined to form other microtip 2202 geometries. Therefore, an unlimited variety of field emission structures in addition to field emission microtip emitters may be created using the method of the invention.

The above description of illustrated embodiments of the invention, including what is described in the Abstract, is not intended to be exhaustive or to limit the invention to the precise forms disclosed. While specific embodiments of, and examples for, the invention are described herein for illustrative purposes, various equivalent modifications are possible within the scope of the invention, as those skilled in the relevant art will recognize.

These modifications can be made to the invention in light of the above detailed description. The terms used in the following claims should not be construed to limit the invention to the specific embodiments disclosed in the specification and the claims. Rather, the scope of the invention is to be determined entirely by the following claims, which are to be construed in accordance with established doctrines of claim interpretation.

What is claimed is:

1. An electron emission structure comprising:

a substrate prepared with a patterned topographical feature extending outwardly;

at least one layer of a first material deposited over the substrate and concurrently etched from the substrate to form an atomically sharp feature on the patterned topographical feature, wherein the at least one layer of first material forms a continuous layer over a top and a side of the patterned topographical feature, wherein the shape of the atomically sharp feature is determined by the shape of the patterned topographical feature;

at least one layer of insulating material deposited over the layer of first material;

a layer of conductive bias material deposited over the layer of insulating material;

a patterned region wherein deposited layers of material are removed to expose the atomically sharp feature; and an electrical connection to elements of the emission structure.

2. The electron emission structure of claim 1 further comprising:

at least one layer of conductive emission material deposited over the atomically sharp feature.

3. The electron emission structure of claim 2 wherein the electrical connection is to the conductive emission layer.

4. The electron emission structure of claim 1 wherein the electrical connection is area addressable.

5. The electron emission structure of claim 1 wherein the electrical connection is device addressable.

6. The electron emission structure of claim 1 wherein the patterned topographical feature is a third material deposited on the substrate.

7. The electron emission structure of claim 1 wherein the patterned topographical feature is etched from the substrate.

8. The electron emission structure of claim 1 wherein the substrate contains another electrically functional device.

9. The electron emission structure of claim 8 wherein the electrically functional device is passive.

10. The electron emission structure of claim 8 wherein the electrically functional device is active.

11. The electron emission structure of claim 1 wherein the at least one layer of first material is a conductive material with a low work function and high emissivity.

12. The electron emission structure of claim 1 wherein an emission enhancing layer is added to the at least one layer of first material.

13. The electron emission structure of claim 1 wherein the electrical connection is to the substrate.

14. A device incorporating electron emission structures, the device comprising:

an external electrical connection providing connectivity external to the device;

an electron emission structure comprising:

a substrate prepared with a patterned topographical feature extending outwardly;

at least one layer of a first material deposited over the substrate and concurrently etched from the substrate to form an atomically sharp feature on the patterned topographical feature, wherein the at least one layer of first material forms a continuous layer over a top and a side of the patterned topographical feature, wherein the shape of the atomically sharp feature is determined by the shape of the patterned topographical feature;

at least one layer of insulating material deposited over the first material;

a layer of conductive bias material deposited over the layer of insulating material;

a patterned region wherein deposited layers of material are removed to expose the atomically sharp feature; and an electrical connection to elements of the emission structure; and an electrical connection between the electron emission structure and the external electrical connection.

15. The device of claim 14 wherein the electron emission structure further comprises at least one layer of conductive emission material deposited over the atomically sharp feature.

16. The device of claim 14 wherein the device dissipates electrostatic charge.

* * * * *

UNITED STATES PATENT AND TRADEMARK OFFICE

CERTIFICATE OF CORRECTION

PATENT NO. : 6,771,011 B2
DATED : August 3, 2004
INVENTOR(S) : Maxim et al.

Figure 2:
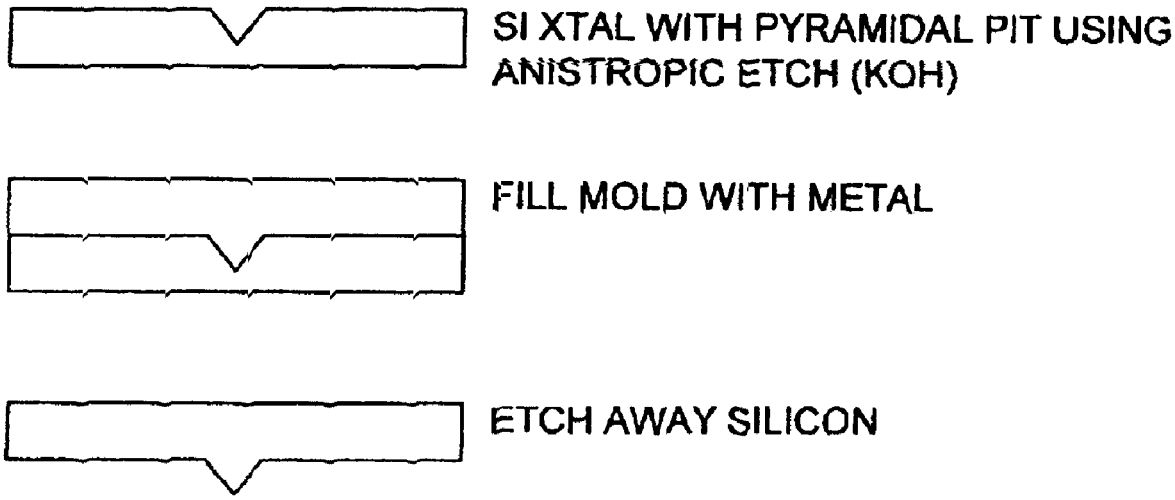
FIG. 2 is an illustration of a technique for creating microtips.
Figure 3:
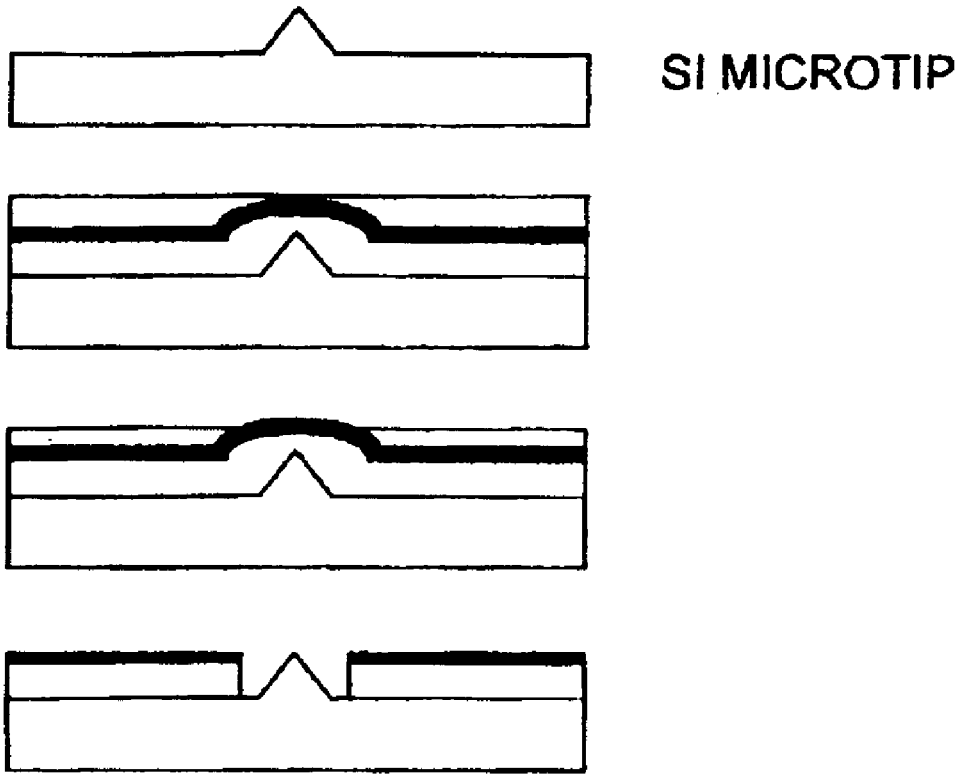
FIG. 3 is an illustration of a technique for creating microtip emitters.
Figure 4:
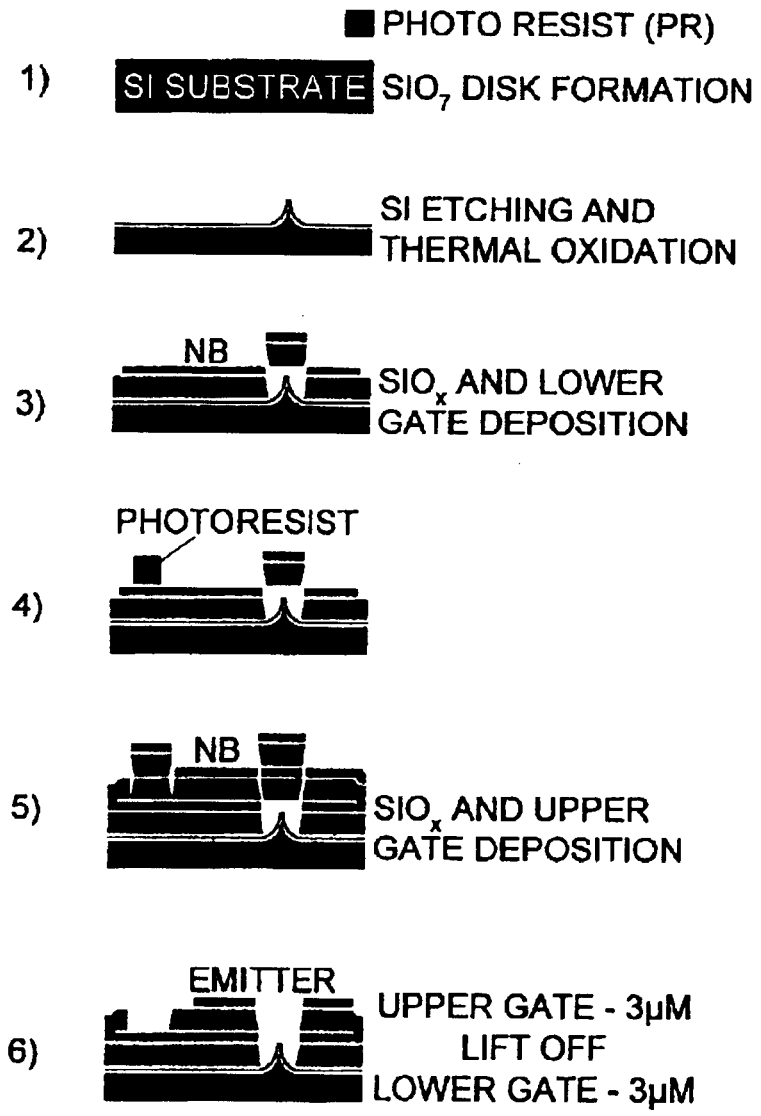
FIG. 4 is an illustration of a technique for creating microtip emitters.
Figure 5:
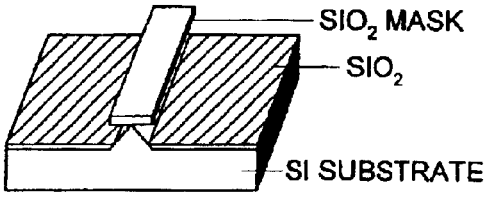
FIG. 5 is an illustration of a technique for creating microtip emitters.
Figure 5:
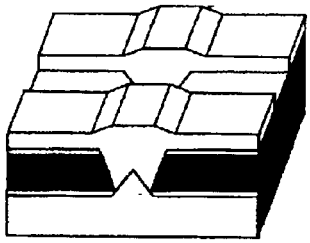
Figure 5:
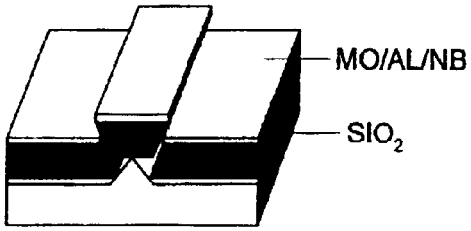
Figure 5:
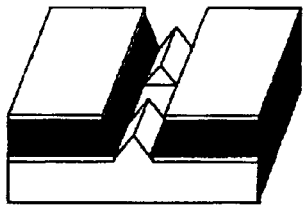
Figure 5:
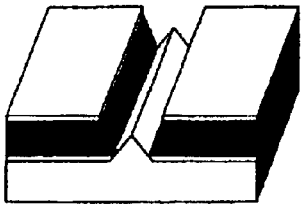
Figure 6:
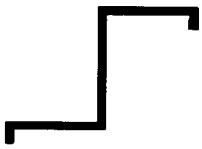
FIG. 6 is an illustration of a technique for creating microtip emitters.
Figure 6:
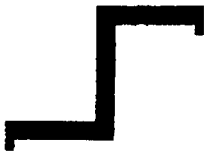
Figure 6:
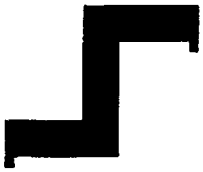
Figure 6:
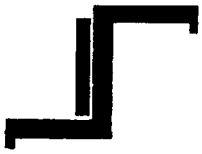
Figure 6:
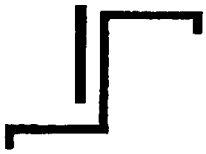
Figure 7:
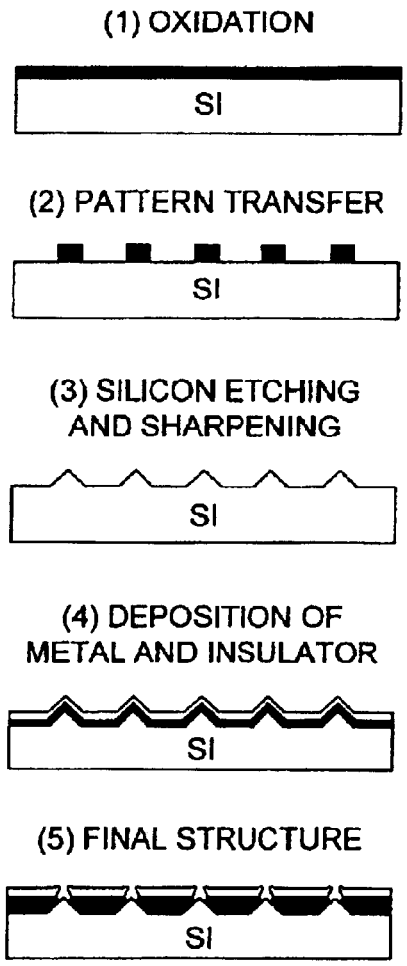
FIG. 7 is an illustration of a technique for creating microtip emitters.
Figure 8:
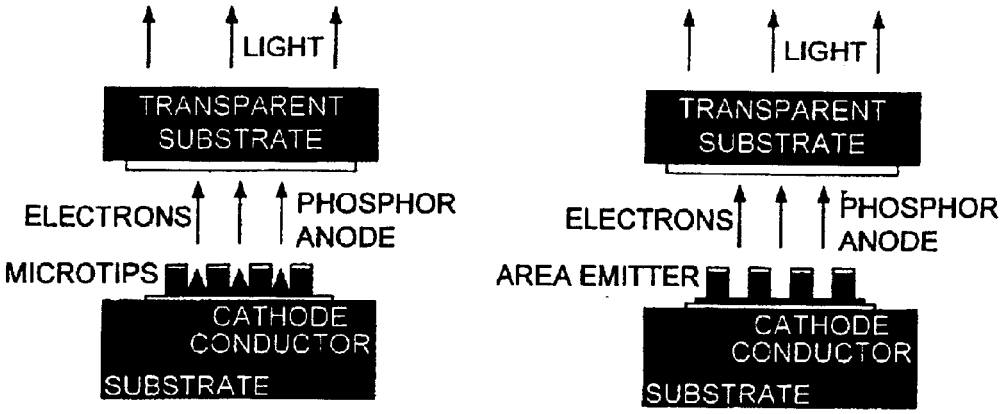
FIG. 8 is an illustration of an application for microtip emitters.
Figure 8:
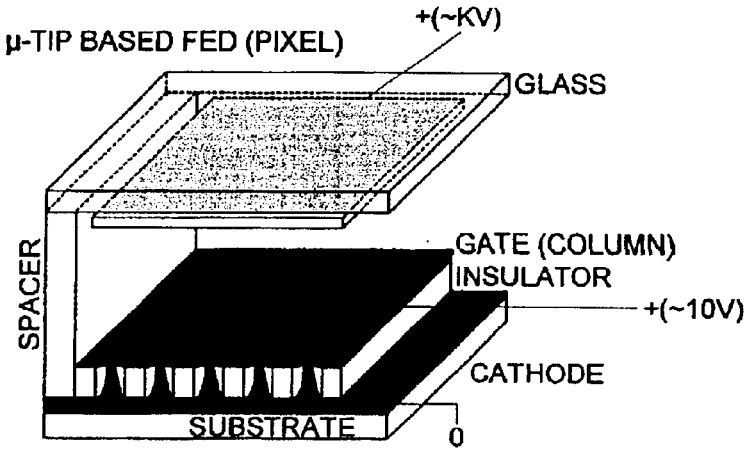

It is certified that error appears in the above-identified patent and that said Letters Patent is hereby corrected as shown below:

Column 2,
Line 12, delete “used,” and insert -- used --.
Line 20, delete “FIG. 2A” and insert -- FIG. 2 --.

Column 5,
Line 10, delete “be-deposited” and insert -- be deposited --.

Signed and Sealed this

Thirtieth Day of November, 2004

JON W. DUDAS
*Director of the United States Patent and Trademark Office*